United States Patent [19]

Lent et al.

[11] Patent Number: 4,929,121

[45] Date of Patent: May 29, 1990

[54] CONTROL SYSTEM FOR A ROAD PLANER

[75] Inventors: Kevin C. Lent, Maple Grove; Conwell K. Rife, Jr., Champlin, both of Minn.; Gerald P. Simmons, Morton; Albert J. Speck, Springfield, both of Ill.

[73] Assignee: Caterpillar Paving Products Inc., Minneapolis, Minn.

[21] Appl. No.: 403,270

[22] Filed: Sep. 5, 1989

[51] Int. Cl.[5] ..... E01C 23/12

[52] U.S. Cl. ..... 404/84; 299/1; 299/39; 404/90; 474/110

[58] Field of Search ..... 404/84, 90, 122; 299/39, 1; 474/101, 110; 307/39

[56] References Cited

U.S. PATENT DOCUMENTS 4,139,318 2/1979 Jakob et al. ..... 404/90

4,406,354 9/1983 Barsted ..... 299/1 X 4,473,319 9/1984 Spangler ..... 404/84 X 4,655,634 4/1987 Loy et al. ..... 404/84

4,780,022 10/1988 Ohiba et al. ..... 404/84 X

*Primary Examiner*—Stephen J. Novosad

*Attorney, Agent, or Firm*—Robert A. McFall

[57] ABSTRACT

A control system for a road planer in which the mechanical drive components are selectively and sequentially controlled in response to operator inputs and to sensed operating conditions. The control also responds to the occurrence of predefined fault events and internal system failures by controlling the operation of one or more of the mechanical drive line components in a preselected order. Suitable time delays are provided between the execution of selected commands to prevent undesirable wear or loads on components of the drive train.

14 Claims, 12 Drawing Sheets

SYSTEM POWER UP
150
INTERNAL FAILURE OR EXTERNAL FLAG
164
152
DEFAULT/START CUTTER MODE 0
INTERNAL FAILURE
164
ABORT MODE
166
154
SERVICE/RESTART CUTTER MODE 1
INTERNAL FAILURE
164
160
SERVICE DOOR OPEN
156
STAND BY CUTTER MODE 2
INTERNAL FAILURE
164
160
SERVICE DOOR OPEN
162
KICKBACK EVENT
164
INTERNAL FAILURE
158
OPERATE CUTTER MODE 3

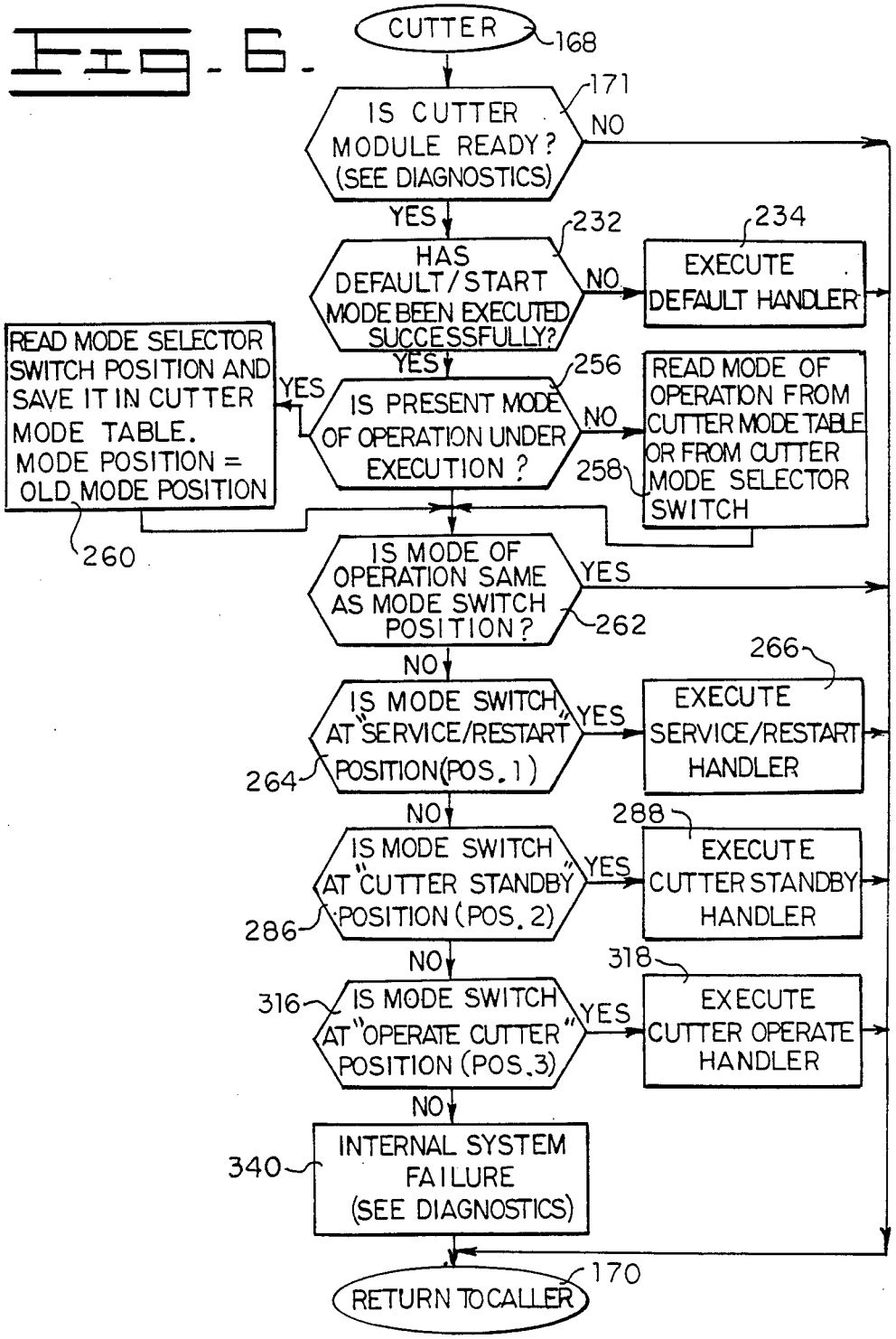
Fig. 6.
CUTTER
168
IS CUTTER MODULE READY? (SEE DIAGNOSTICS)
171
NO
YES
HAS DEFAULT/START MODE BEEN EXECUTED SUCCESSFULLY?
232
NO
EXECUTE DEFAULT HANDLER
234
YES
IS PRESENT MODE OF OPERATION UNDER EXECUTION ?
256
YES
NO
READ MODE SELECTOR SWITCH POSITION AND SAVE IT IN CUTTER MODE TABLE. MODE POSITION = OLD MODE POSITION
260
READ MODE OF OPERATION FROM CUTTER MODE TABLE OR FROM CUTTER MODE SELECTOR SWITCH
258
IS MODE OF OPERATION SAME AS MODE SWITCH POSITION?
262
YES
NO
IS MODE SWITCH AT "SERVICE/RESTART" POSITION(POS. 1)
264
YES
EXECUTE SERVICE/RESTART HANDLER
266
NO
IS MODE SWITCH AT "CUTTER STANDBY" POSITION (POS. 2)
286
YES
EXECUTE CUTTER STANDBY HANDLER
288
NO
IS MODE SWITCH AT "OPERATE CUTTER" POSITION (POS. 3)
316
YES
EXECUTE CUTTER OPERATE HANDLER
318
NO
INTERNAL SYSTEM FAILURE (SEE DIAGNOSTICS)
340
RETURN TO CALLER
170

DIAGNOSTICS
172
IS CUTTER DOOR OPEN
174
YES
EXECUTE ACCESS DOOR HANDLER
176
NO
IS INTERNAL SYSTEM FAILURE DETECTED
194
YES
EXECUTE INTERNAL FAILURE HANDLER
196
NO
IS MODE OF OPERATION AT MODE 3
216
NO
YES
IS KICKBACK EVENT DETECTED
218
NO
YES
EXECUTE KICKBACK HANDLER
220
CUTTER MODULE = READY
230
CLUTCH MODULE = NOT READY
214
RETURN TO CALLER
170

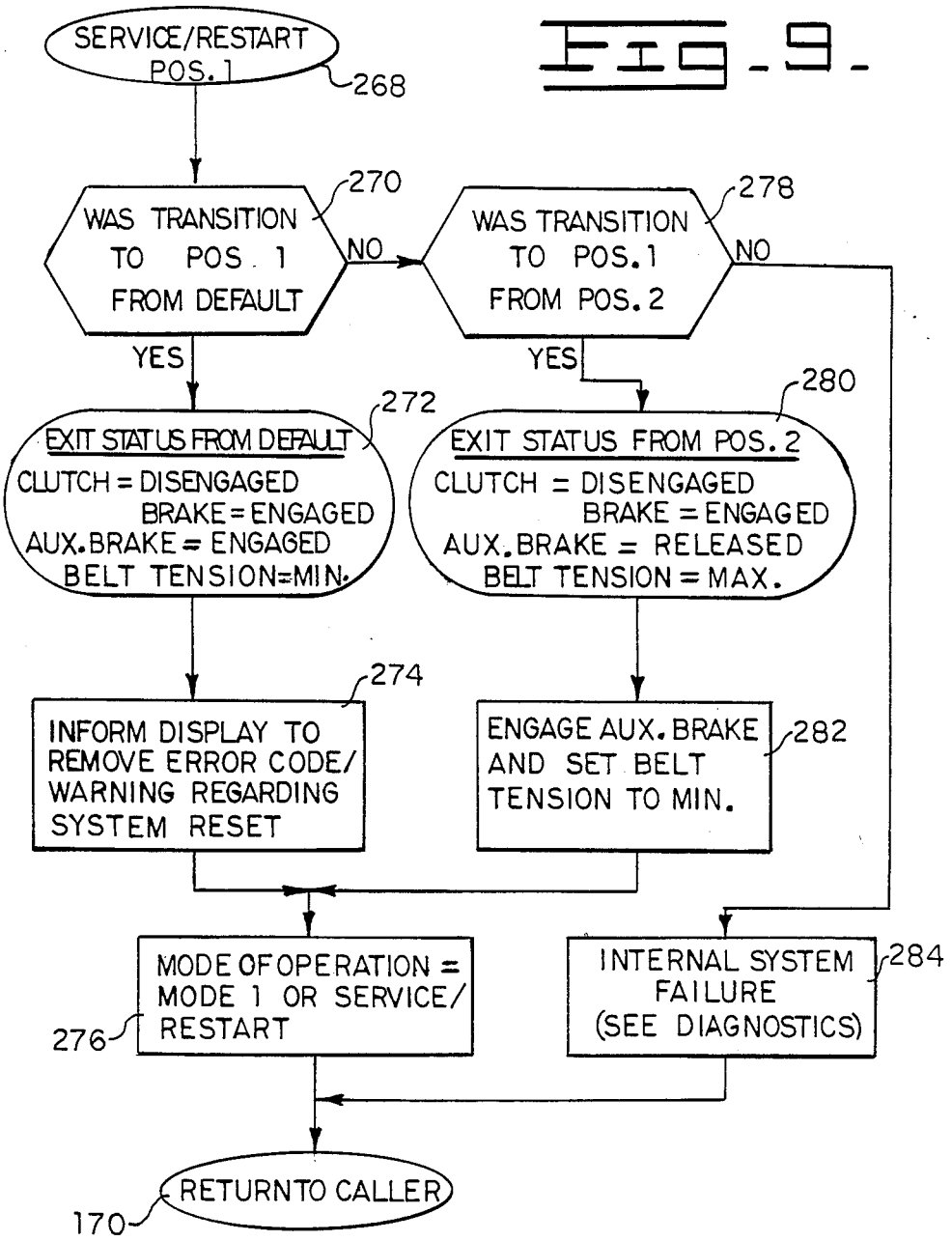
SERVICE/RESTART POS. 1
268
FIG. 9
WAS TRANSITION TO POS. 1 FROM DEFAULT
270
NO
WAS TRANSITION TO POS. 1 FROM POS. 2
278
NO
YES
YES
EXIT STATUS FROM DEFAULT
CLUTCH = DISENGAGED
BRAKE = ENGAGED
AUX. BRAKE = ENGAGED
BELT TENSION = MIN.
272
EXIT STATUS FROM POS. 2
CLUTCH = DISENGAGED
BRAKE = ENGAGED
AUX. BRAKE = RELEASED
BELT TENSION = MAX.
280
INFORM DISPLAY TO REMOVE ERROR CODE/ WARNING REGARDING SYSTEM RESET
274
ENGAGE AUX. BRAKE AND SET BELT TENSION TO MIN.
282
MODE OF OPERATION = MODE 1 OR SERVICE/ RESTART
276
INTERNAL SYSTEM FAILURE (SEE DIAGNOSTICS)
284
RETURN TO CALLER
170

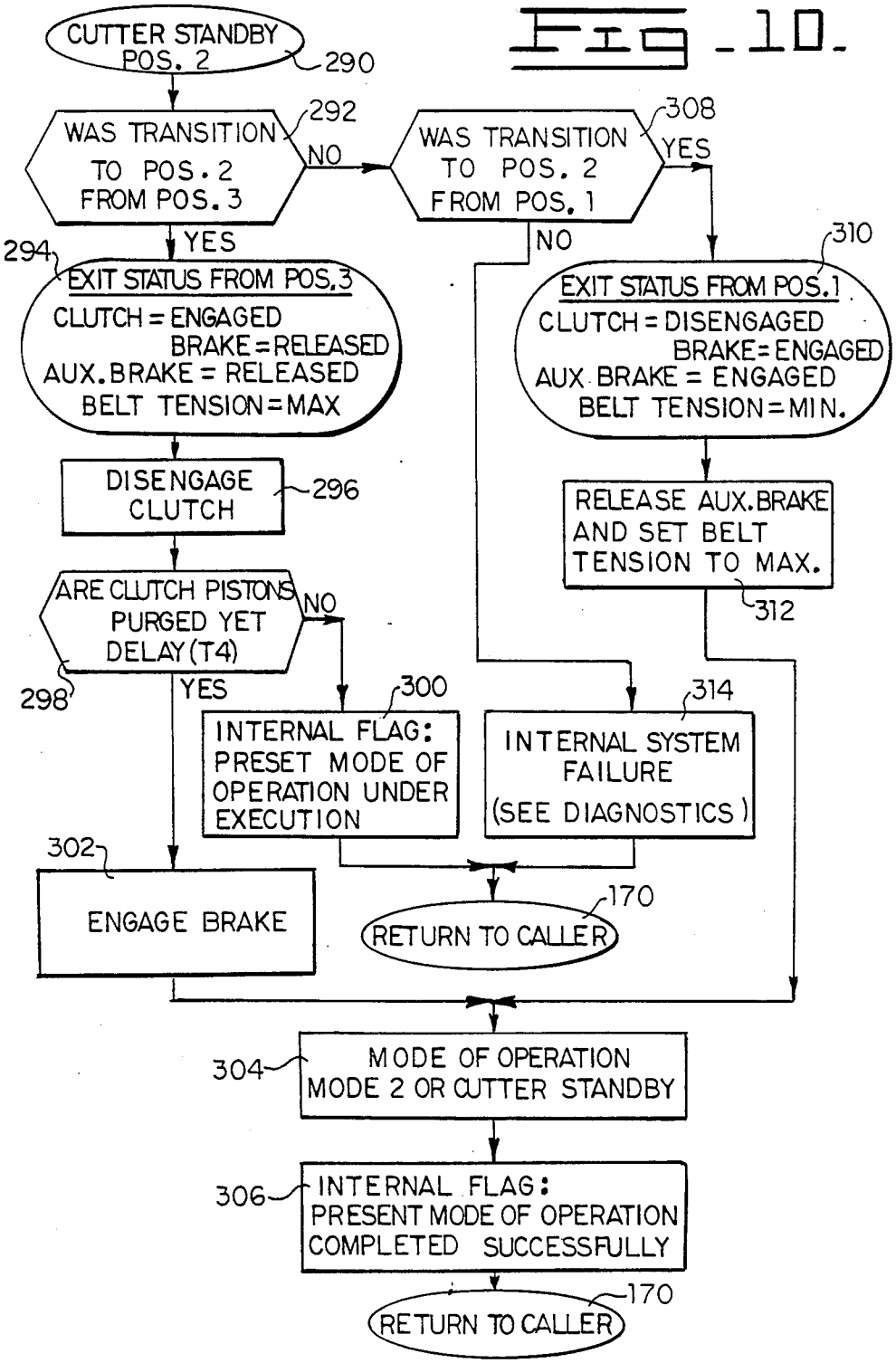
Fig. 10.
CUTTER STANDBY POS. 2
290
WAS TRANSITION TO POS. 2 FROM POS. 3
292
NO
YES
WAS TRANSITION TO POS. 2 FROM POS. 1
308
YES
NO
294
EXIT STATUS FROM POS. 3
CLUTCH = ENGAGED
BRAKE = RELEASED
AUX. BRAKE = RELEASED
BELT TENSION = MAX
310
EXIT STATUS FROM POS. 1
CLUTCH = DISENGAGED
BRAKE = ENGAGED
AUX. BRAKE = ENGAGED
BELT TENSION = MIN.
DISENGAGE CLUTCH
296
RELEASE AUX. BRAKE AND SET BELT TENSION TO MAX.
312
ARE CLUTCH PISTONS PURGED YET DELAY (T4)
NO
298
YES
300
INTERNAL FLAG: PRESET MODE OF OPERATION UNDER EXECUTION
314
INTERNAL SYSTEM FAILURE (SEE DIAGNOSTICS)
302
ENGAGE BRAKE
170
RETURN TO CALLER
304
MODE OF OPERATION MODE 2 OR CUTTER STANDBY
306
INTERNAL FLAG: PRESENT MODE OF OPERATION COMPLETED SUCCESSFULLY
170
RETURN TO CALLER

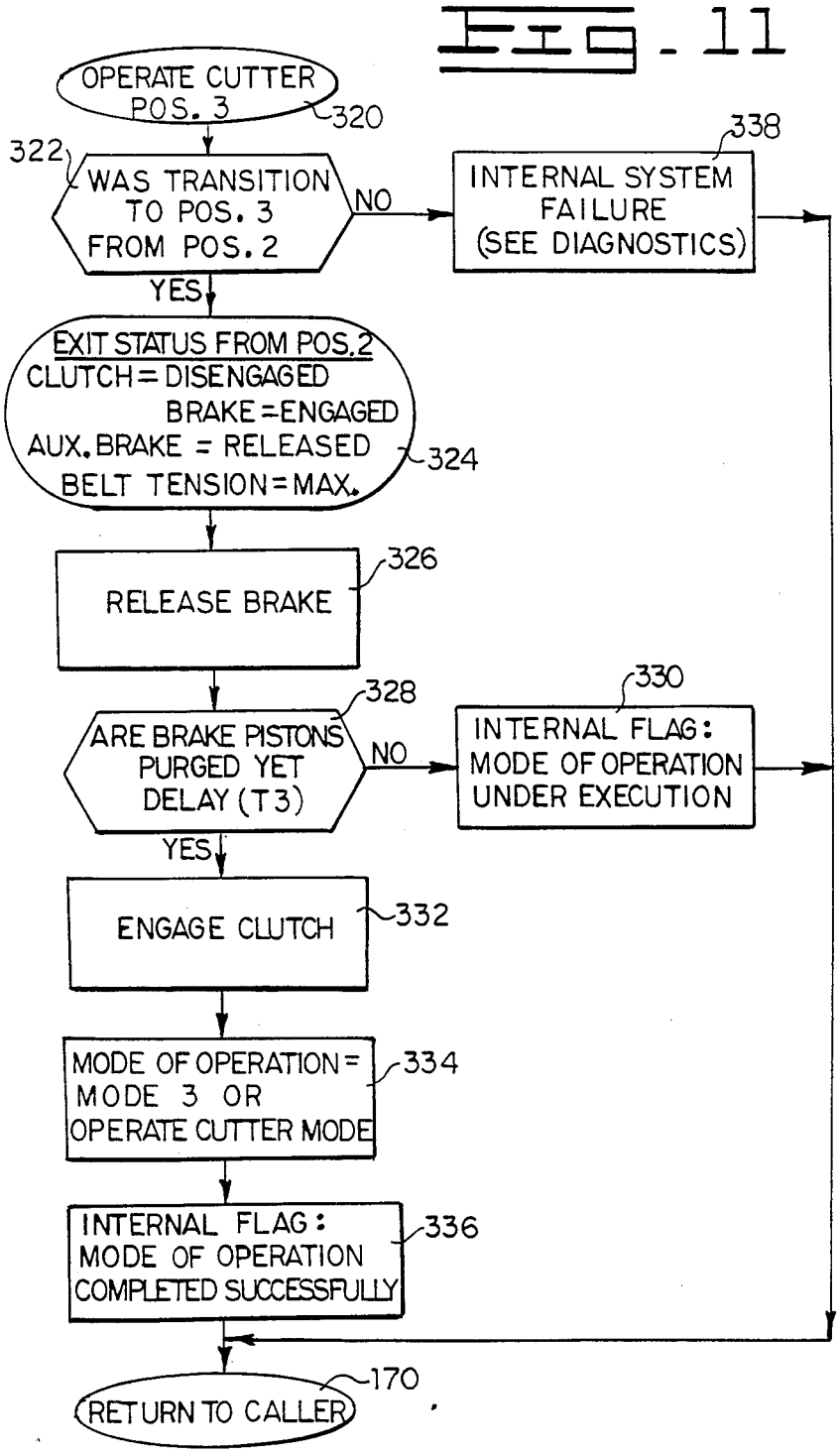
Fig. 11
OPERATE CUTTER POS. 3
320
322
WAS TRANSITION TO POS. 3 FROM POS. 2
NO
338
INTERNAL SYSTEM FAILURE (SEE DIAGNOSTICS)
YES
EXIT STATUS FROM POS. 2
CLUTCH = DISENGAGED
BRAKE = ENGAGED
AUX. BRAKE = RELEASED
BELT TENSION = MAX.
324
RELEASE BRAKE
326
328
ARE BRAKE PISTONS PURGED YET DELAY (T3)
NO
330
INTERNAL FLAG: MODE OF OPERATION UNDER EXECUTION
YES
ENGAGE CLUTCH
332
MODE OF OPERATION = MODE 3 OR OPERATE CUTTER MODE
334
INTERNAL FLAG: MODE OF OPERATION COMPLETED SUCCESSFULLY
336
RETURN TO CALLER
170

CONTROL SYSTEM FOR A ROAD PLANER

DESCRIPTION

1. Technical Field

This invention relates generally to a control system for the rotary cutter of a road planer and more particularly to a control system for a road planer having a mechanically driven rotary cutter.

2. Background Art

Road planers, also known as pavement profilers, road milling machines or cold planers, are machines designed for scarifying, removing, mixing or reclamation, of material from the surface of bituminous or concrete roadways and similar surfaces. These machines typically have a plurality of tracks or wheels which support and horizontally transport the machine along the surface of the road to be planed, and have a rotatable cutter that is vertically adjustable with respect to the road surface.

The rotatable cutter may be driven hydraulically by a remotely powered fluid motor or directly through a drive train mechanically connecting the cutter to an engine. A control system for a road planer having a hydraulically driven rotary cutter is described in U. S. Pat. No. 4,655,634, issued April 7, 1987 to Robert E. Loy et al. This reference describes an electrical circuit which is interrupted when an access door on the rotary cutter is opened. When the electrical circuit is interrupted, the cutter is prevented from rotating and the machine cannot be moved.

However, hydraulically powered motor systems are typically less efficient in transmitting power to the cutter than mechanical drive arrangements which directly connect the cutter to the engine. Mechanical drive arrangements are also particularly suited for mounting the cutter directly on the frame of the road planer. Mounting of the cutter, or more specifically the cutter bearing housings, directly on the vehicle frame provides rigidity between the cutter and the machine suspension system thereby minimizing undesirable deflection of the cutter during the surface milling or planing operation. For these reasons, it is desirable to mount the rotatable cutter and the engine driving the cutter directly on the vehicle frame and provide a direct mechanical drive between the engine and the cutter.

Heretofore, mechanically driven cutters have been coupled to the engine by a belt drive arrangement that typically includes an air operated clutch connecting the engine output shaft to a drive pulley. The drive pulley is linked to a driven pulley on the cutter mandrel by a plurality of v-belts. Tension in the v-belts is provided by manually adjusting an idler pulley or, alternatively, manually repositioning the drive pulley with respect to the driven pulley. Often, it is necessary to slacken or remove tension from the v-belts to facilitate replacement of individual cutting tools or otherwise service the rotary cutter. Heretofore, this has required manual adjustment of the belt tensioning mechanism.

The present invention is directed to overcoming the problems set forth above. It is desirable to have a mechanically driven rotary cutter in which the v-belt drive component is selectively and automatically tensioned or slackened. It is also desirable to have a system for controlling the mechanical drive system so that preselected components of the system, including the automatic belt tensioning mechanism, are engaged in a preselected sequential order in response to one or more control signals.

DISCLOSURE OF THE INVENTION

In accordance with one aspect of the present invention, a control system for a road planer having a cutter rotatably mounted on the planer and an engine operatively connected to the cutter, includes a clutch operatively connected to the engine, a brake operatively connected to an output shaft extending from the clutch, a pulley operatively connected to the clutch output shaft and a second pulley connected to the rotatably mounted cutter. An endless belt extends between the pulleys, and a mechanism is provided for tensioning the belt and urging it into driving contact with both of the pulleys. The clutch, brake and belt tensioning mechanism each have a control to govern their respective operations. These operational controls are, in turn, automatically controlled by a control that, in response to receiving a specific operating mode command signal, appropriately regulates one or more of the operational controls in a preselected sequential order.

Other features of the control system include a sensor capable of sensing at least one operating condition and delivering a corresponding signal to the control regulating the operation of the respective clutch, brake and belt tensioning controls.

Another feature of the control system includes an auxiliary brake interposed the first mentioned brake and the pulley operatively connected to the output shaft. The auxiliary brake is operatively controlled by the control for the belt tensioning mechanism.

BRIEF DESCRIPTION OF THE DRAWINGS

FIG. 6 is a flow diagram showing the cutter control logic sequence;

FIG. 9 is a flow diagram showing the Service/Restart mode logic sequence;

FIG. 10 is a flow diagram showing the Cutter Standby mode logic sequence;

FIG. 11 is a flow diagram showing the Cutter Operating mode logic sequence;

BEST MODE FOR CARRYING OUT THE INVENTION

Figure 1:
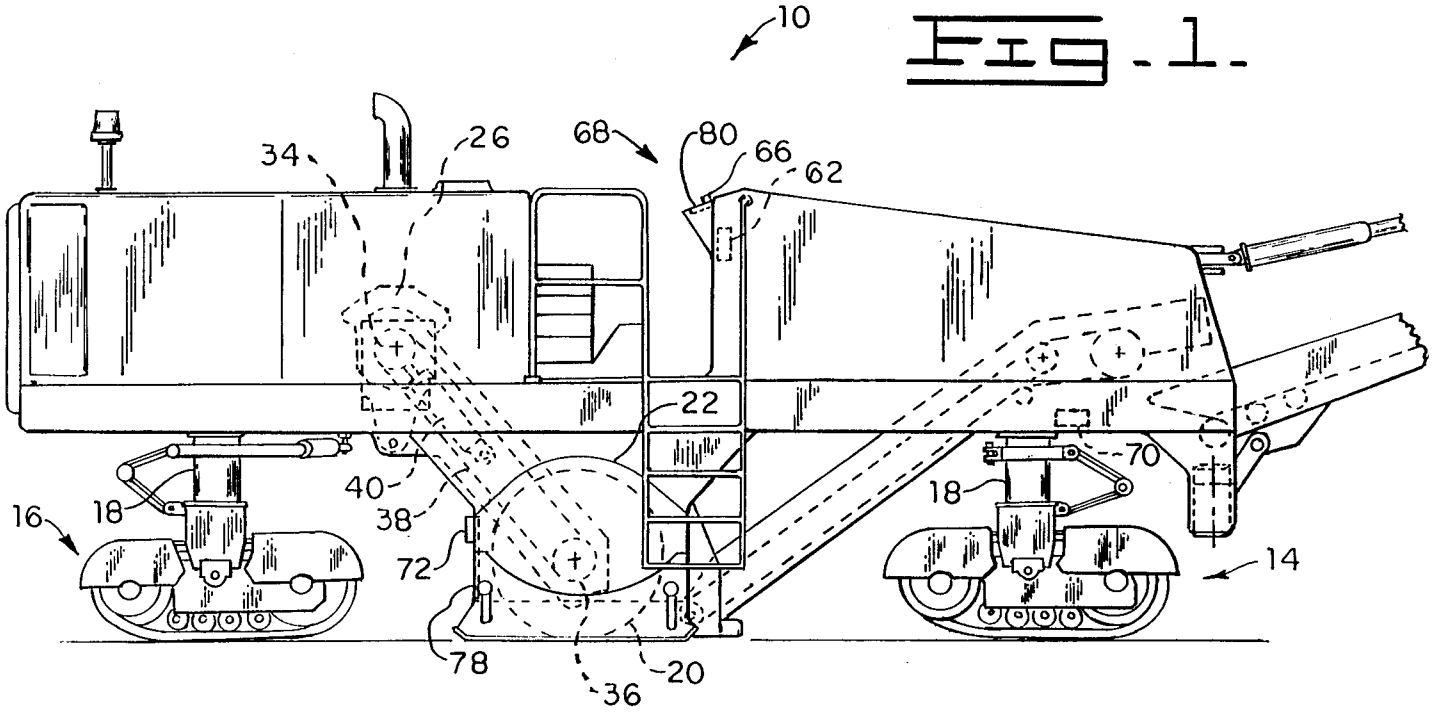
FIG. 1 is a side view of a road planer having a control system embodying the present invention.

A road planer, generally indicated by the reference numeral 10, comprises a frame 12 that is carried for movement along a road surface by a pair of front track assemblies 14 and a pair of rear track assemblies 16. The frame 12 is supported on the track assemblies 14,16 by a hydraulically actuated adjustable strut 18 extending respectively between each of the track assemblies and the frame. A rotary cutter 20 is rotatably mounted on the frame 12 and has a housing 22 surrounding all but the bottom of the cutter 20 which is necessarily exposed to the road surface. With the cutter 20 mounted directly to the frame 12, the vertical relationship of the rotary cutter 20 with respect to the road surface, i.e., the depth of cut or penetration of the cutting teeth carried on the cutter 20 into the ground, is controlled by appropriate extension or retraction of one or more of the adjustable struts 18. The road planer 10 also includes an engine 26 as a source of power to drive the rotary cutter 20. The engine 26 is mechanically connected to the rotary cutter 20 by a direct mechanical drive arrangement.

Figure 2:
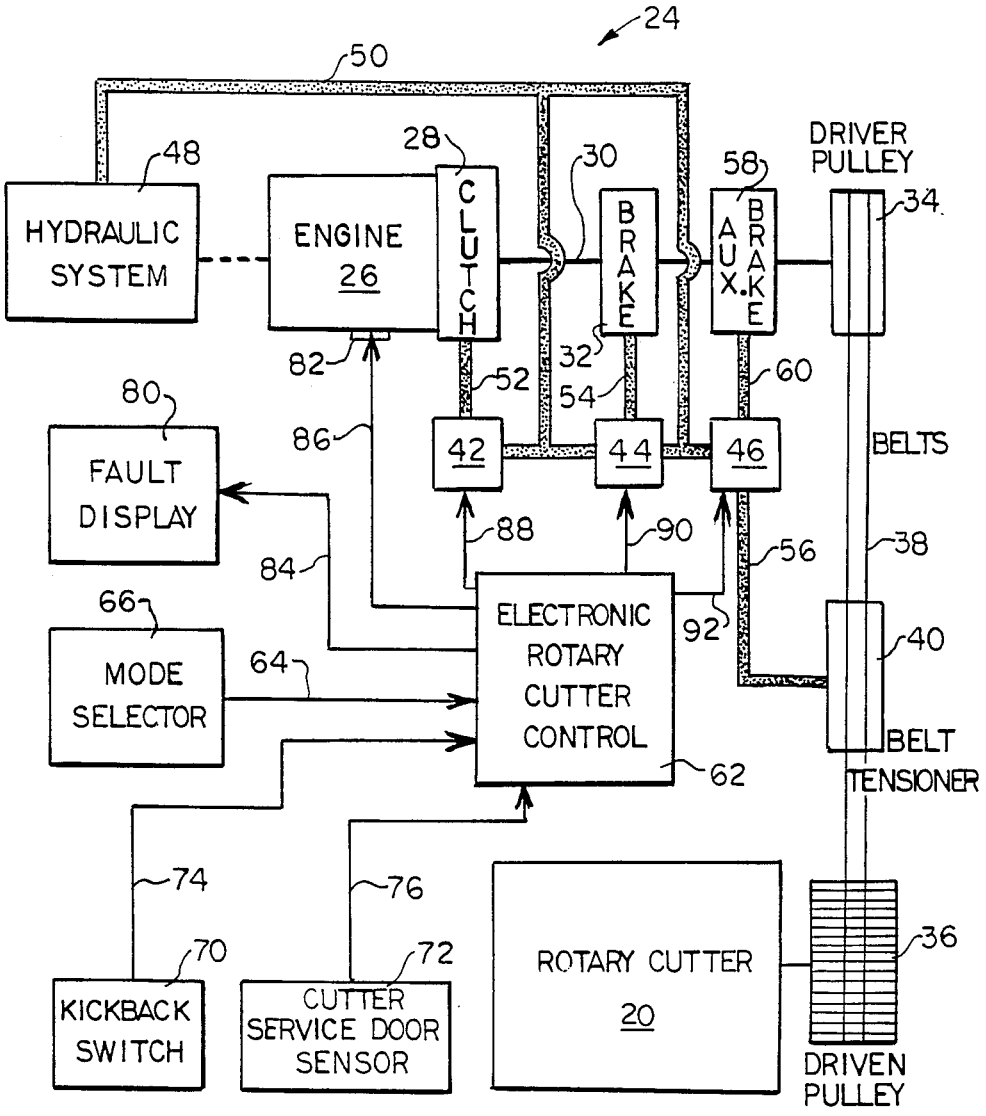
FIG. 2 is a schematic diagram showing principal elements of the control system embodying the present invention.

In the preferred embodiment of the present invention, shown schematically in FIG. 2, a control system 24 for the rotary cutter 20 of the road planer 10 comprises a hydraulically actuated wet disc clutch 28 directly connected to the engine 26 and an output shaft 30 extending from the clutch 28. A hydraulically actuated brake 32 and a first, or drive, pulley 34 are operatively connected to the output shaft 30. A second, or driven, pulley 36 is connected directly to the mandrel of the rotary cutter 20, and an endless belt 38, preferably a single joined v-belt or a plurality of separate v-belts, extends between the first and second pulleys 34,36.

Means for tensioning the endless belt 38, for the purpose of urging the belt into driving contact with both pulleys 34,36, is provided by a hydraulically actuated belt tensioner 40. The belt tensioner 40 may be a conventional idler pulley that is selectively urged to and held, by a hydraulic cylinder, in a position that effectively increases the distance between the pulleys 34,36. Alternatively, the output shaft 30 may include one or more universal joints that permit the first pulley to be adjustably positioned with respect to the second pulley 36. In this arrangement, an extensible hydraulic cylinder having one end attached to the frame 12 and a second end attached to a non-rotating bearing housing supporting the first pulley, may be selectively extended to increase the actual distance between the first and second pulleys 34,36.

Control means for selectively engaging and disengaging clutch 28, selectively applying and releasing the brake 32, and selectively engaging and releasing the belt tensioner 40 are provided, respectively, by solenoid operated hydraulic flow control valves 42, 44 and 46. A hydraulic system 48 provides a source of pressurized fluid to each of the flow control valves 42, 44 and 46 through a conduit 50. Conduits 52, 54 and 56, communicating respectively between the clutch control valve 42 and the clutch 28, the brake control valve 44 and the brake 32, and the belt tensioner control valve 46 and the belt tensioner 40, direct the flow of pressurized fluid to the clutch, brake and belt tensioner.

Preferably, the mechanical drive train connecting the rotary cutter 20 the engine 26 includes an auxiliary brake operatively connected to the output shaft 30 and disposed between the primary brake 32 and the first pulley 34. The auxiliary brake is desirably a spring actuated, hydraulically released brake. A conduit 60 provides fluid communication between the auxiliary brake 58 and the belt tensioner hydraulic flow control valve 46. Hence, in the preferred embodiment, a flow of pressurized hydraulic fluid is supplied simultaneously to the auxiliary brake 58 and the belt tensioner 40 when the belt tensioner control valve is open to the supply conduit 50, thereby concurrently tensioning the v-belts 38 and releasing the auxiliary brake 58. When the belt tension control valve is closed, or the flow of pressurized fluid to the auxiliary brake and the belt tensioner 40 otherwise interrupted such as by equipment power failure, tension in the v-belts 38 is relaxed and the spring actuated auxiliary brake 50 is applied.

Operation of the clutch control means 42, the brake control means 44, and the belt tensioner control means 46 is governed by an electronic rotary cutter control 62. The electronic rotary cutter control 62 is preferably mounted in a protective enclosure on the road planer 10 and controls one or more of the control means 42, 44, 46 in a preselected sequential order in response to receiving an output signal from a switch or sensor.

Specifically, an operating mode signal 64 is developed and delivered to the electronic control 62 by a mode selector switch 66 positioned at an operator's station 68 on the road planer 10. Preferably, the mode selector switch 66 is a rotary switch developing a pulse-width modulated signal corresponding to a selected operating mode. In the preferred embodiment illustrative of the present invention, the mode selector switch 66 has, in addition to an off position, three detent positions corresponding to first, second and third operating modes. The first operating mode is a service or restart mode in which the clutch 28 is disengaged, the brake is applied, and belt tension is released. In the second operating mode, designated as a standby mode, the clutch 28 and the brake 32 remain in their first mode state, i.e., respectively disengaged and applied, but the belt tensioner control valve 46 is opened thereby applying tension to the v-belts 38 and releasing the auxiliary brake 58. In the third, or normal, operating mode the belt tension control valve remains open, the brake 32 is released, and the clutch is engaged. Thus, in the third mode, the rotary cutter 20 is mechanically linked to the engine 26 and power is transferred directly from the engine to the rotary cutter.

Preferably, additional control signals representative of selected vehicle operating conditions are developed and delivered to the electronic rotary cutter control 62. In the preferred embodiment representative of the present invention, a kickback switch 70 and a cutter service door position sensor 72 respectively develop and deliver a kickback event signal 74 and a service door position signal 76.

The kickback switch 70 is a pressure switch sensing fluid pressure in the hydraulic circuit regulating the height of the adjustable strut 18 attached to at least one of the front track assemblies 14. If, during a planing operation, the cutter 20 encounters a hard object or material and begins to ride up, i.e., rise out of the cut, an automatic level control on the road planer, not shown, will attempt to correct the attitude of the planer 10. As a result, the automatic level control will reduce pressure in the circuits controlling extension of the struts 18 connecting the front track assemblies 12 to the vehicle frame 12. When the pressure drops below a predetermined value in the front strut hydraulic circuit, the kickback switch 70 is triggered, thereby producing the kickback event signal 74.

The service door position sensor 72 is mounted on a panel 78 covering an access opening in the cutter housing 22. The service door position sensor 72 is preferably a rotary switch producing a pulse-width modulated analog signal corresponding to the position of the panel 78 with respect to the cutter housing 22.

The control system 24 also includes a fault display 80 and a fuel shut-off valve 82. The fault display is preferably a monitor or liquid crystal display mounted on a panel at the operator's station 68. The fuel shut-off valve is preferably a solenoid actuated valve positioned in the fuel supply line to the engine 26. Control signals 84, 86, 88, 90, 92 are developed by the electronic rotary cutter control 62 and delivered, respectively, to the fault display 80, fuel shut-off valve 82, clutch control valve 42, brake control valve 44, and belt tension control valve 46.

Figure 3:
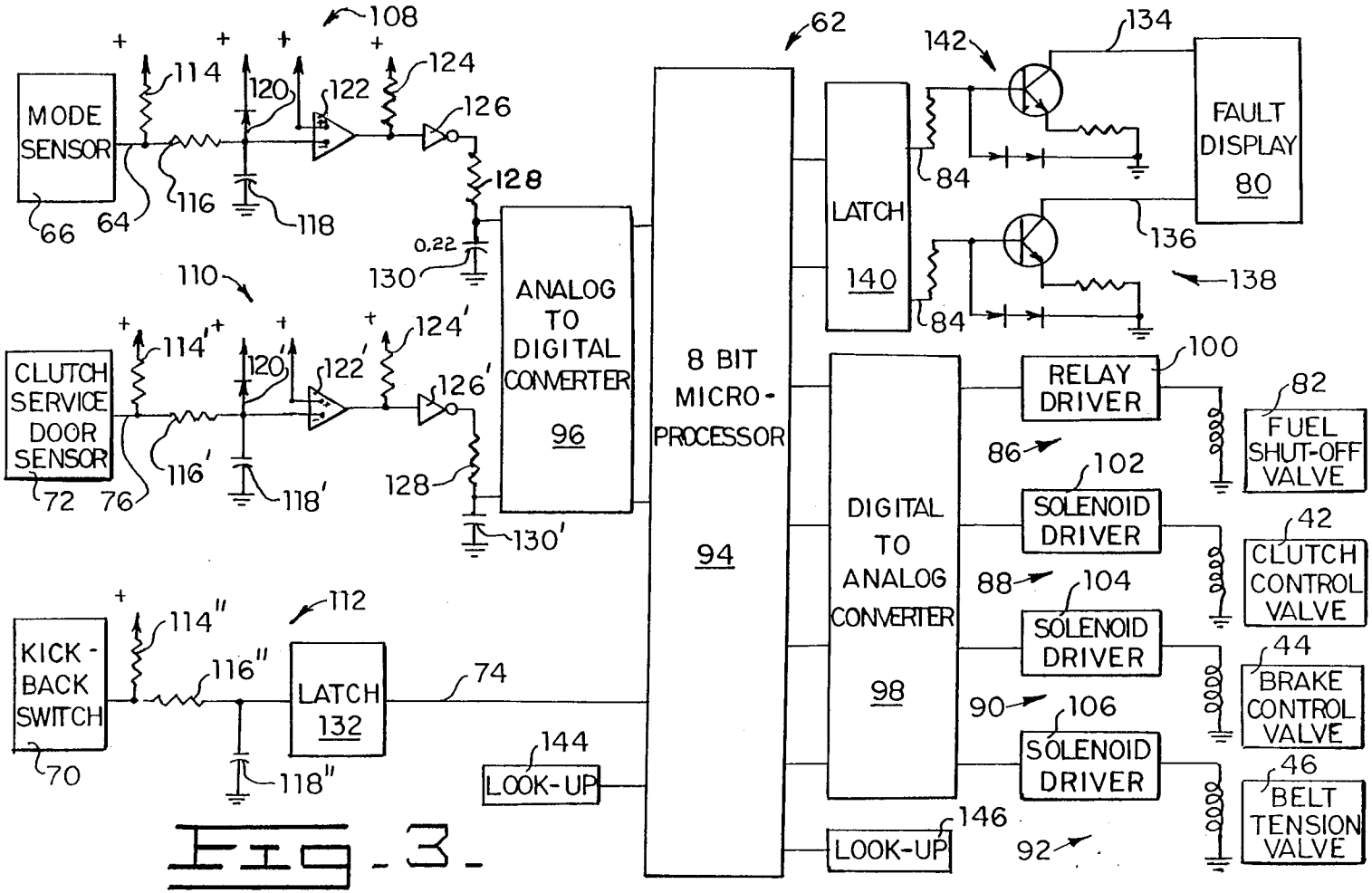
FIG. 3 is a diagram showing the electrical circuit of the control system embodying the present invention.

The electronic rotary cutter control 62, shown schematically in FIG. 3, comprises a Motorola 6809 8-bit programmable microprocessor 94, and an analog to digital converter 94 for converting the pulse-width modulated analog input signals 64, 76 to digital signals. The electronic cutter control 62 also includes a digital to analog convertor 98 for converting the digital output of the microprocessor 94 to the analog control signals 86,88,90,92 delivered respectively to a relay driver 100 controlling the operation of the fuel shut-off valve 82, and to solenoid drivers 102, 104, 106 controlling the operation, respectively, of the clutch control valve 42, the brake control valve 44, and the belt tension valve 46.

The electronic rotary cutter control 62 also includes signal conditioning circuits 108, 110, for regulating and filtering the pulse-width modulated operating mode signal 64 and service door position signal 76, respectively, and an input signal conditioning circuit 112 for filtering and latching the kickback event signal 74.

Specifically, each of the signal conditioning circuits 108, 110, 112 includes a respective pull-up resistor 114, 114', 114'' connected between the associated sensor and a +14 volt supply source. The pulse-width modulated signal conditioning circuits 108, 110 also include R/C filters connected respectively from the mode sensor 66 and the clutch service door sensor 72 to the noninverting input of comparators 122, 122''. The R/C filters include input resistors 116, 116' and capacitors 118, 118'. The output of the R/C filters is connected to the anode of respective biasing diodes 120, 120', the cathode of which is connected to a +5 volt supply source. The noninverting input of the comparators 122, 122' is connected to a +2.5 volt supply source. The output of the comparators 122, 122' is connected to the input of respective operational amplifier buffers 126, 126' and to pull-up resistors 124, 124', which are in turn connected to the +5 volt supply source. The output of the operational amplifiers 126, 126' are connected to respective output filter circuits having input resistors 128, 128' and capacitors 130, 130'. The output of these filters is delivered to an analog to digital convertor 96 prior to being delivered to the microprocessor 94.

In the case of the kickback event signal conditioning circuit 112, an R/C filter comprising an input resistor 116'' and a capacitor 118'' is connected from the kickback switch 70 to the input of a latch 132. This latch holds the circuit in the last set condition, i.e. on or off, thus providing conditioned digital signals 74 suitable for input directly to the microprocessor 94. In the above discussion the values of the voltage sources are those utilized in the preferred embodiment but can be modified to suit other circuit arrangements and components.

When a fault occurs, the microprocessor 94, as will be later described, determines the relative urgency of the detected fault and accordingly develops either a low level warning signal 134, or a high level warning signal 136. The digital fault signals 134, 136 developed by the microprocessor 94 are delivered to the fault display monitor 80 by a fault signal conditioning circuit 138 comprising a latch 140 and a fault display drive circuit 142.

INDUSTRIAL APPLICABILITY

In operation, the electronic rotary cutter control 62 sequentially controls, in a preselected order, the mechanical components of the control system 24 in response to receiving one or more of the output signals 64, 74, 76. The logic for executing the control functions is programmed into the programmable microprocessor 94 and will be explained in more detail below.

Figure 4:
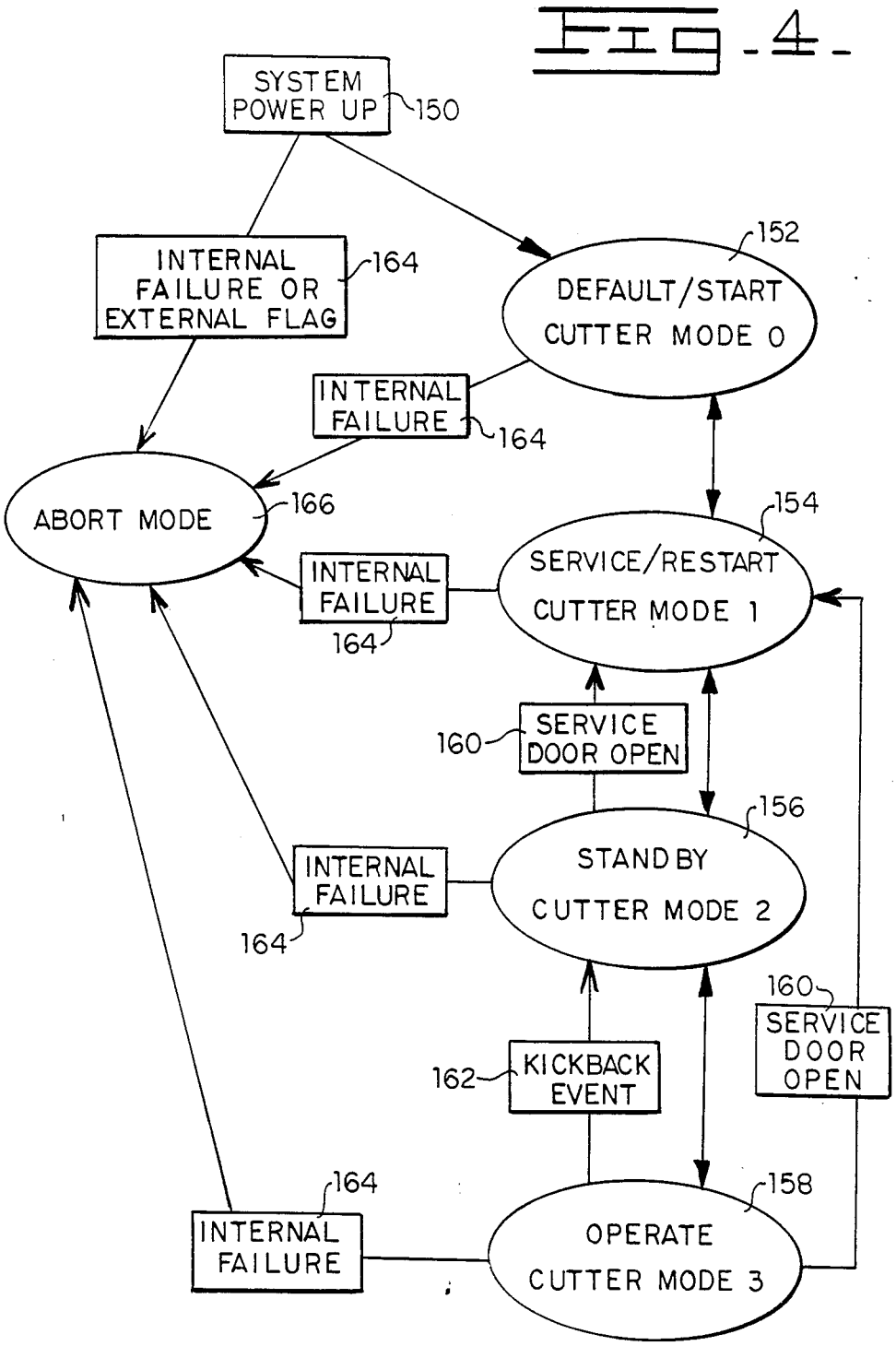
FIG. 4 is a logic diagram showing the transitional interrelationship of the operating modes.

The relationship between cutter operating modes is shown in FIG. 4. The normal sequence for transition between modes is indicated by the flowlines having solid arrowheads. Specifically, upon powering up the system, 150, the control enters a default/start mode 152, designated as mode 0, which is identical to the previously described operator selected mode 1, i.e., the service/restart mode which is identified by the reference numeral 154 in FIG. 4. Transition from one operating mode to another must be carried out sequentially between adjacent modes, e.g., from service/restart mode 1, 154, to standby mode 2, 156, or from mode 2 to operate cutter mode 3, 158 or vice versa.

If a fault is detected, the electronic cutter control 62 defaults to a condition indicated by the flowlines having open arrowheads. For example, if it is detected that the position of the service door is in any position other than closed, 160, the electronic control will automatically default to the service/restart mode 1 until the door is closed. If a kickback event 162 is detected during normal operation, i.e., while in mode 3, the control will default to standby mode 2. If an internal system failure 164 is detected while in any mode, the control will default to an abort mode 166 in which all mechanical components of the control system 24 including the engine 26 are shut down. The cause of the fault or internal failure must be corrected before the electronic control 62 will permit return to normal operation.

Figure 5:
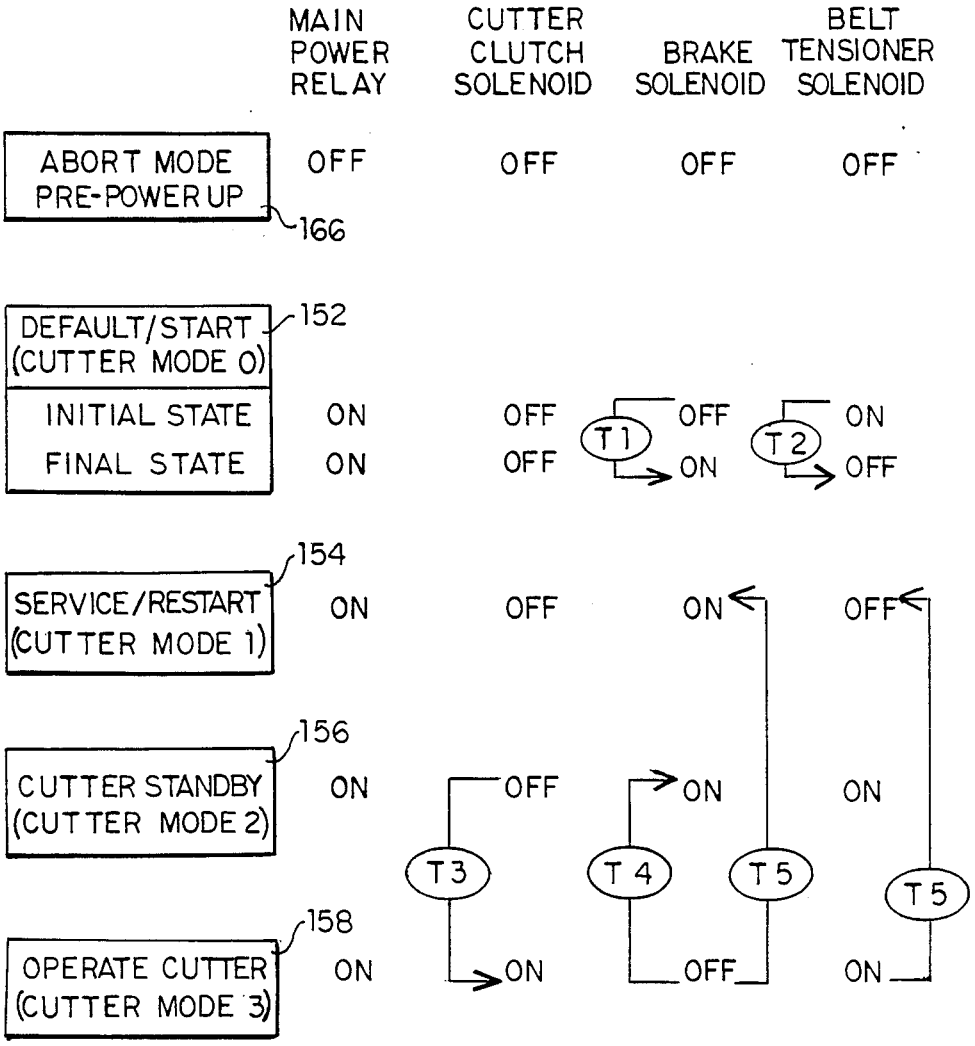
FIG. 5 is a diagram showing the programmed time delays during transition between operating modes.

To avoid excessive wear and prevent possible damage to the drive train components comprising the control system 24, it is desirable to sequentially engage or disengage appropriate elements of the system. For example, to avoid unnecessary wear the brake 32 should not be applied until the clutch 28 is disengaged. For this reason time delays, identified as delays T1 to T5 in FIG. 5, are included in the logic programmed into the microprocessor 94.

By way of further example, as noted in the above remarks with respect to FIG. 4, if the service door 78 should open during operation of the cutter i.e., mode 3, the electronic cutter control 62 will automatically default to service/restart mode 1. As shown in FIG. 5, the solenoid actuated clutch control valve 42 is immediately deactivated without any time delay, thereby disengaging the clutch 28. After a predesignated time delay, identified as T5, to permit the clutch pistons to be purged, the solenoid actuated brake control valve 44 is energized thereby applying the brake 32, and the solenoid actuated belt tensioner control valve 46 is deactivated thereby releasing tension on the belt 38 and applying the auxiliary brake 58. The actual length of the time delays T1 to T5 will depend on the size and characteristics of the particular mechanical components, but typically are on the order of 1 to 5 seconds.

Preferably the programmable microprocessor 94 is programmed according to the logic sequences shown in FIGS. 6 through 14. In addition to the programmed instructions illustrated in the flowcharts, the microprocessor 94 is accessed to one or more look-up tables 144, 146 providing reference values for system generated signals such as the pulse width modulated signals 64, 76.

Figure 7:
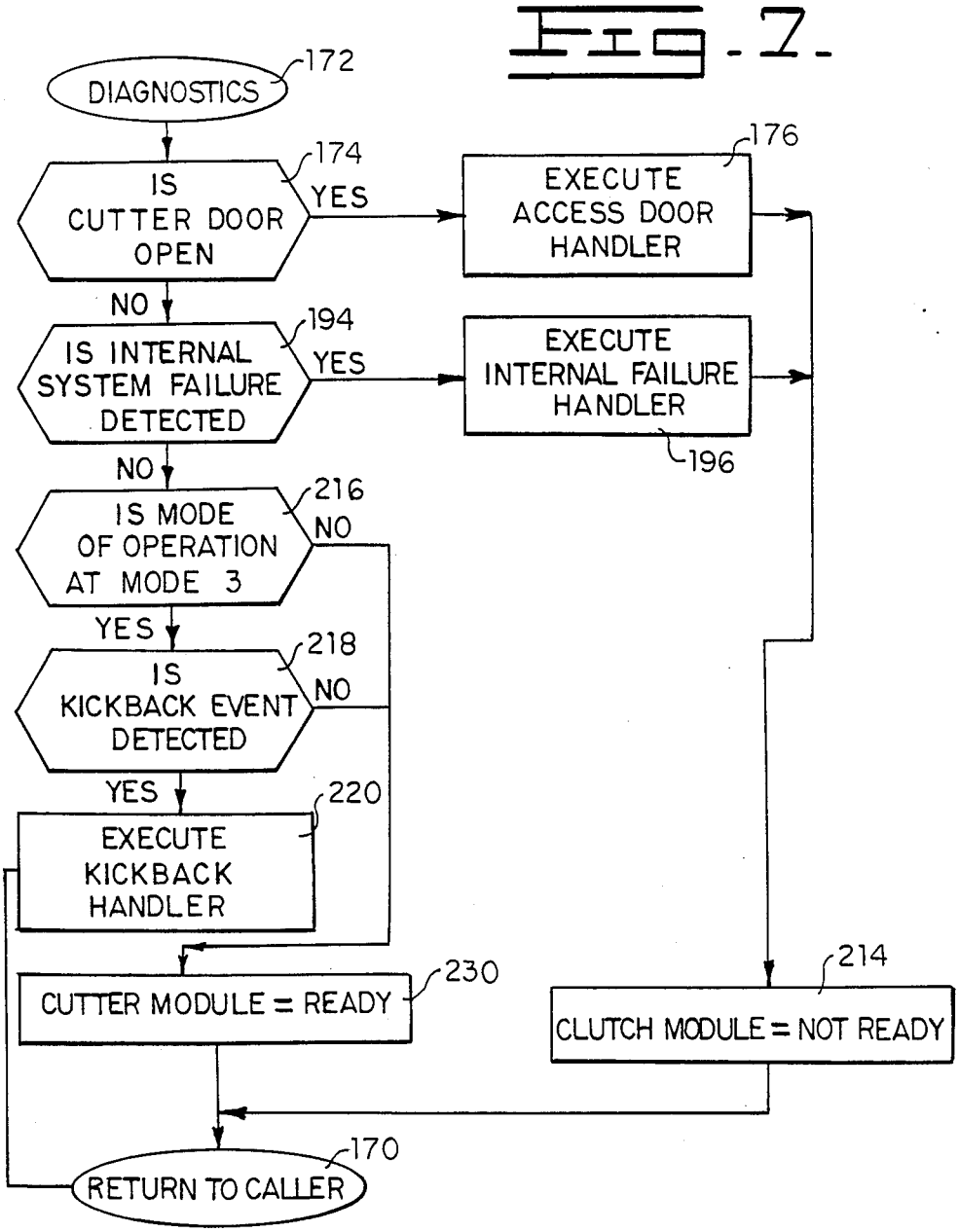
FIG. 7 is a flow diagram showing the diagnostic logic sequence.
Figure 8:
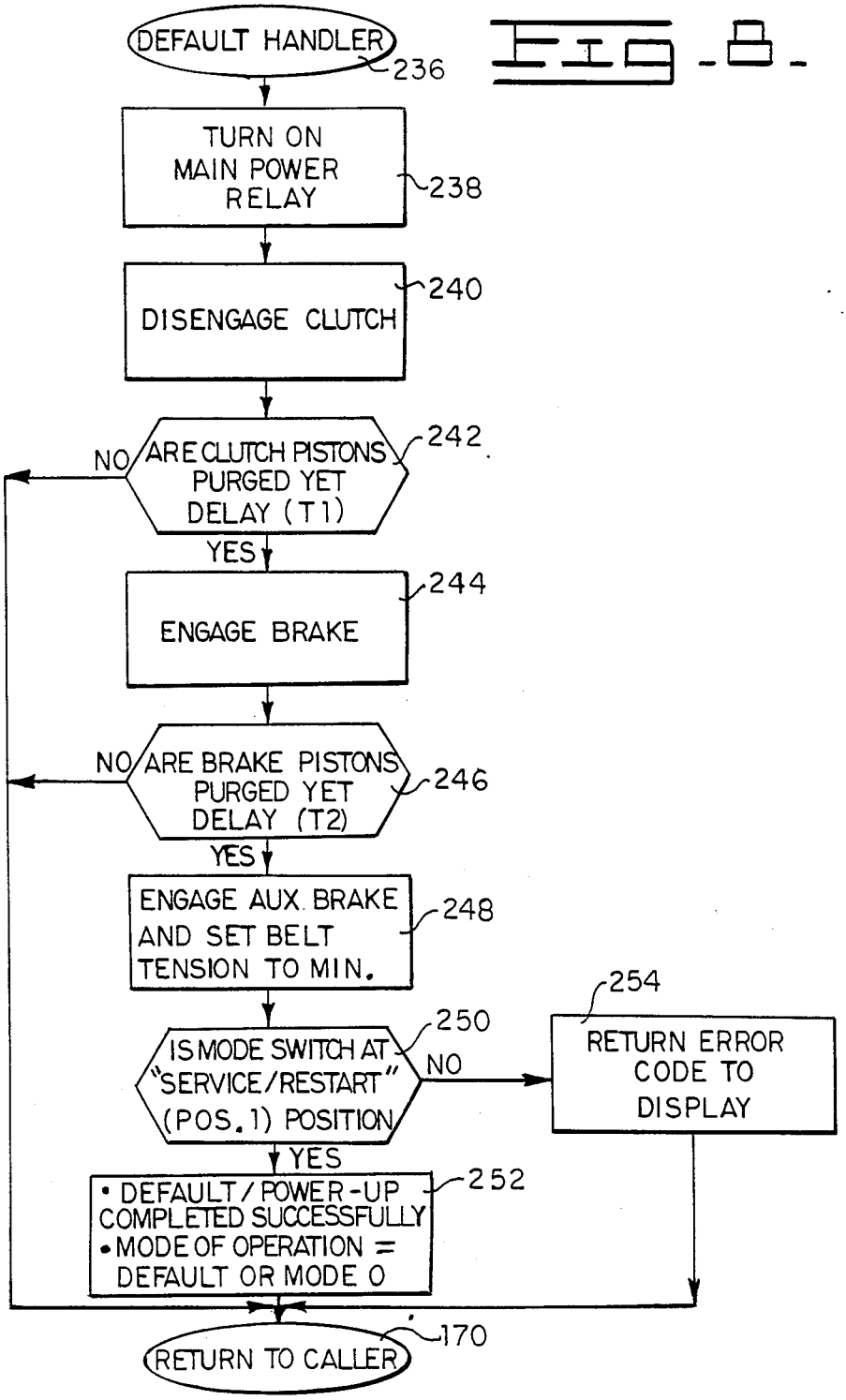
FIG. 8 is a flow diagram showing the default logic sequence.
Figure 12:
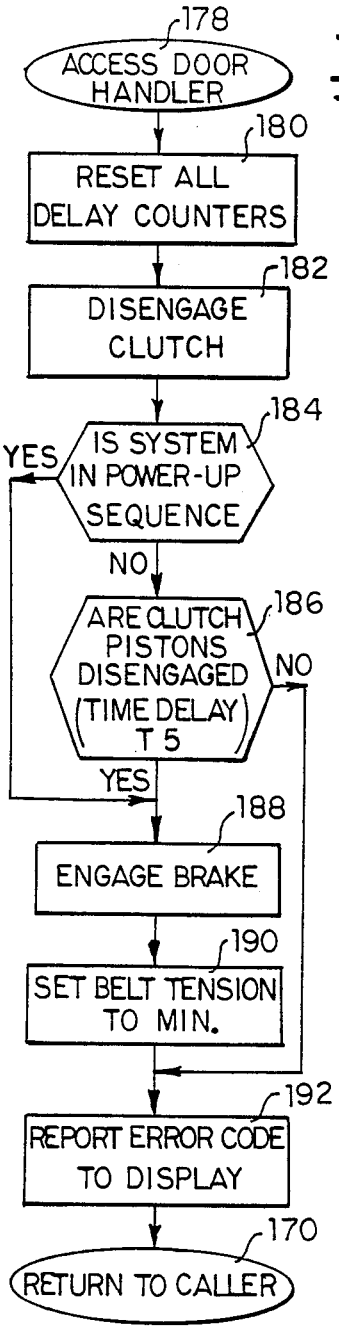
FIG. 12 is a flow diagram showing the Access Door logic sequence.

It should be noted that the primary cutter command program 168, illustrated in FIG. 6, is part of a computational loop or caller 170 that first determines if the cutter module is ready, as indicated by decision box 171, and if not, executes the diagnostics routine 172 shown in FIG. 7. The diagnostics routine checks for faults that must be corrected before proceeding with execution of the primary cutter control module. If the service door position sensor 72 indicates that the door 78 is open, represented by the decision box 174, a command 176 is given to execute the access door handler subroutine 178 shown in FIG. 12.

The access door handler 178 resets all of the delay counters, 180, and issues a command 182 to disengage the clutch. If the system is not currently in a power-up sequence 184, the program checks to determine if the clutch pistons are disengaged 186. This determination is made affirmatively if the time delay (T5) has expired. If the system is in a power-up sequence, the clutch will already be disengaged, and the time delay requirement will be bypassed. After being assured that the clutch is disengaged, commands 188, 190 are given to respectively engage the brake and release the belt tensioner. A command 192 is then executed which sends a high level warning signal 136 with an identifying error code indicating that the access door is open to the fault display monitor 80. Execution is then returned to the caller 170 for reexecution of the aforementioned routines until the cutter door is closed, at which time the cutter door status inquiry 174 in the diagnostics routine 172 is answered negatively.

After determining that the cutter door is not open, the diagnostics routine 172, as shown in FIG. 7, checks for the presence of an internal system failure 194. If an internal system failure is detected, such as the unintended or abnormal functioning of a component internal to the system, e.g., a short or an open circuit, or as a result of a command developed by one of the subroutines to be subsequently described, a command 196 is given to execute the internal system failure handler 200 shown in FIG. 13. The internal system failure program executes a series of commands, 202, 204, 206, 208, 210, to respectively reset all delay counters, shut down the engine, disengage the clutch, engage the brake, and release the belt tensioner. A command 212 is also executed which sends a high level warning signal 136 with an identifying error code indicating an internal system failure to the fault display monitor 80. Execution is then returned to the caller 170 for reexecution of the aforementioned cutter and diagnostics routines 168, 172 until the internal failure is corrected. Therefore, either an open access panel or an internal failure will result in a command to return to the caller 170. This condition, is indicated in FIG. 7 by the action box 214, clutch module = not ready.

After correction of an internal system failure, or in the absence of such failure, diagnostics routine 172 proceeds to determine if the current mode of operation is the cutter operate mode, i.e., mode 3, as indicated by the decision box 216. If the mode of operation is Mode 3, an inquiry 218 is made to determine if a kickback event is detected.

Figure 14:
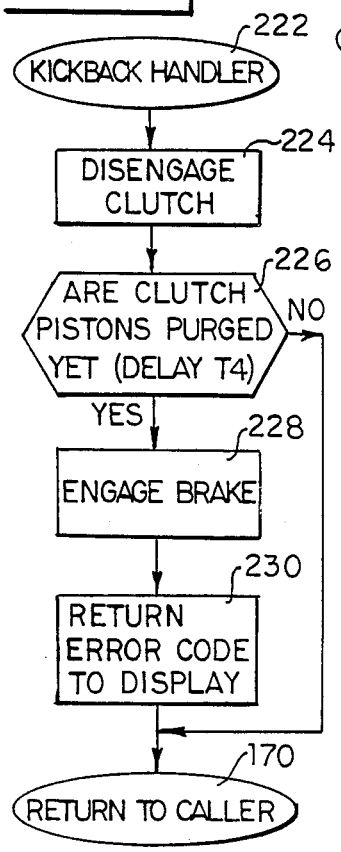
FIG. 14 is a flow diagram of the Kickback logic sequence.

If a kickback event is sensed, a command 220 is given to execute the kickback handler 222 shown in FIG. 14. The kickback handler program 222 issues a command 224 to disengage the clutch and then, after determining that the clutch pistons are purged 226, i.e., that the time delay (T4) has been satisfied, a command 228 is given to engage the brake. A command 230 is also executed which develops a high level warning signal 136 with an identifying error code indicating the presence of a kickback event and delivers the warning and code to the fault display monitor 80. Execution is returned to the caller 170 until the kickback fault condition is corrected.

Referring again to the diagnostics routine shown in FIG. 7, if the cutter door status inquiry 174, the internal system inquiry 194, the mode 3 operation inquiry 216 and the kickback event inquiry 218 all have a negative response, the conditions of the diagnostics routine 172 have been satisfied and the cutter module is in a ready condition as indicated by the action box 230. The diagnostics routine 172 thereby repetitively monitors system failure and fault signals and develops and executes output signals to control operation of the rotary cutter 20.

Turning again to FIG. 6, when an affirmative response is received from the diagnostics routine, i.e., cutter module is ready, the cutter program 168 proceeds to determine, as indicated by decision box 32, if the default/start mode has successfully executed. If the default/start mode has not been successfully executed, a command 234 is given to execute the default handler 236 described in FIG. 8.

The default handler 236 turns on the main power relay, 238, disengages the clutch, 240, and after a predetermined time delay (T1), 242, applies the brake, 244. Following a second time delay (T2), 246, a command 248 is given to release the belt tensioner 40 and apply the auxiliary brake 58. If the mode selector switch 66 is set at the service/restart mode 1 position, as indicated by the decision box 250, the default routine has been successfully executed and the mode of operation is set as mode 0, as shown in action box 252, and execution returns to the caller 170. If the mode selector switch 66 is set at a position other than the mode 1 service/restart position, a low level warning signal 134, represented by the action box 254, is developed by the microprocessor 94 and delivered to the fault display 80. Exit from the diagnostics routine cannot be completed until the mode selector switch is set to the mode 1 position.

After the diagnostics and default routines, 172, 236, have been successfully executed, the cutter program 168 proceeds to determine, as represented by the decision box 256 (FIG. 6), if the present mode of operation is being executed. If the response to this determination is negative, a command 258 is given to read the mode of operation from the a temporary cutter mode table or from the cutter mode selector switch. If the response to the inquiry regarding execution of the present mode of operation is affirmative, a command 260 is given to update the cutter mode table. The operating mode information 258, 260, developed in the response to the inquiry 256 regarding present mode execution status, is then compared, as indicated by decision box 262, with the mode selected by the operator, i.e., the position of the mode selector switch 66. If the present operating mode and the position of the operator controlled mode position switch correlate, the program returns to the caller 170 for reexecution of the cutter routine 168. If the mode selected by the operator does not agree with the present operational mode, a comparison 264 is made to see if the mode selector switch is at position 1, the service/restart position. If, at this point, the mode selector switch 66 is at position 1, a command 266 is given to execute the service/restart subroutine 268 shown in FIG. 9.

Figure 13:
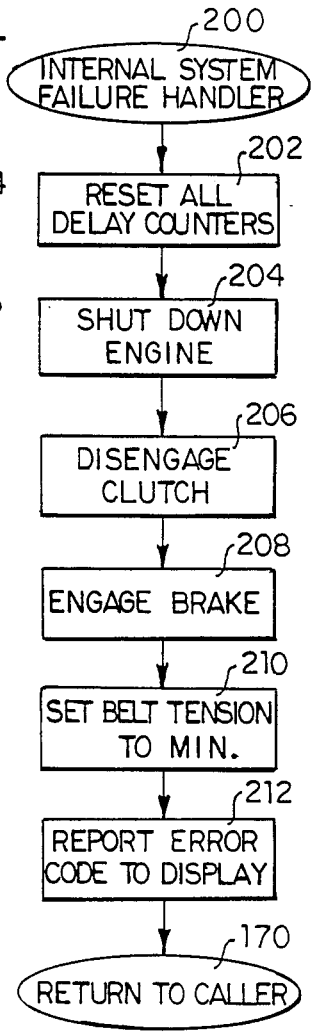
FIG. 13 is a flow diagram showing the Internal System Failure logic sequence.

The service/restart subroutine 268 begins by determining, as indicated by the decision box 270, if the transition to this mode (mode 1) was from the default mode. If affirmative, the exit status of the cutter drive components is summarized in information box 272, and a first command 274 is given to remove the warning and error code from the fault display. This is then followed by a second command 276 to set the mode of operation in the temporary cutter mode table at mode 1, and execution is returned to the caller 170. If the transition to the service restart mode was not from the default mode, a determination is made, as shown by decision box 278, if the transition was from position 2, the standby mode. If affirmative, the exit status of the cutter drive components is summarized in information box 280, and a command 282 is given to place the drive components in service/restart mode, i.e., with the auxiliary brake engaged and the belt tension released, prior to setting the mode of operation at mode 1, as indicated by the command box 276 and returning execution to the caller 170. If transition to the service/restart mode was not from the default or standby modes, an internal system failure command 284 is developed, followed by return to the caller whereupon the failure command thus developed signals the diagnostics routine 172 (FIG. 7) to execute the previously described internal system failure handler 200 (FIG. 13).

Turning again to FIG. 6, if the mode of operation does not agree with the position of the mode switch, and the mode switch is not at position 1, a determination is made, as indicated by decision box 6, if the mode selector switch is in position 2, the cutter standby mode. If affirmative, a command 288 is given to execute the cutter standby subroutine 290, shown in FIG. 10.

The cutter standby mode 290 begins by determining, as indicated by the decision box 292, if the transition to this mode (mode 2) was from the cutter operate mode (mode 3). If affirmative, the exit status of the cutter operate mode is summarized in information box 294 and a command 296 is given to disengage the clutch. Until a predetermined time delay (T4) has elapsed, indicated by the decision box 98, a command 300 is given to generate an internal flag that the present mode of operation is still being executed, and execution is returned to the caller 170. After it is determined that the clutch pistons have been purged, i.e., after the time delay (T4), a command 302 is given to engage the brake, followed by commands 304, 306 to respectively update the cutter mode table to reflect that the mode of operation is now mode 2, and issue an internal flag that transition to the present mode of operation has been successfully completed, prior to returning execution to the caller 170. If transition to the cutter standby mode was not from the operate mode (mode 3), a determination 308 is made if the transition was from the service/restart mode (mode 1). If affirmative, the exit status of the cutter drive components are summarized in information box 310, and a command 312 is given to release the auxiliary brake and engage the belt tensioner, after which the previously described commands 304, 306 to respectively update the cutter mode table and issue an internal flag indicating that there has been a successful transition to the present mode are generated. If transition to the cutter standby mode was not from mode 3 or mode 1, an internal system failure command 314 is developed, followed by a return to the caller 170 for execution of the internal system failure handler 200 (FIG. 13) as described above.

Turning once again to FIG. 6, if the mode of operation does not agree with the position of the mode switch, and the mode switch is not set at position 1 or position 2, a determination is made, as indicated by the decision box 316 if the mode selector switch is set at position 3, the operate cutter mode. If affirmative, a command 318 is given to execute the cutter standby routine 320 shown in FIG. 11.

The operate cutter routine 320 begins by determining, as indicated by the decision box 322, if the transition to mode 3 was from the cutter standby mode (mode 2). If affirmative, the exit status of the cutter drive components, i.e., the status of the components while operating in mode 2, is summarized in information box 324 and a command 326 is developed to release the brake. Until a predetermined time delay (T3) has elapsed, indicated by the decision box 328, a command 330 is given to set an internal flag indicating that the present mode of operation is still being executed, and execution if returned to the caller 170. After it is determined that the brake pistons have been purged, i.e., after the time delay (T3), a command 332 is given to engage the clutch, followed by commands 334, 336 to respectively update the cutter mode table and set and internal flag indicating that transition to the operate mode has been successfully carried out, prior to returning execution to the caller 170. If transition to the cutter operate mode (mode 3) was not from the cutter standby mode (mode 2), an internal system failure command 338 is developed, followed by return to the caller 170 whereupon, in the previously described manner, the internal failure routine 200 (FIG. 13) is executed.

Turning still once more to FIG. 6, if the cutter program 168 fails to initiate the transition to, or continuation in, an operator selected operating mode, an internal system failure is indicated, whereupon a command 340 is developed. After return to the caller 170 and subsequent reexecution of the cutter module ready inquiry 171, execution is directed to the diagnostics routine 172 (FIG. 7) to carry out, in the above described manner, the internal system failure routine 200 shown in FIG. 13. As noted earlier, execution of the internal system failure routine places the cutter drive components in the abort mode and delivers a high level warning signal 136 to the fault display monitor 80.

Furthermore, as illustrated by the flowcharts shown in FIGS. 6 through 14 and the above description of the flowcharts, it can be seen that the control system software routinely examines all inputs and outputs to ensure that internal system failures and preselected external fault conditions do not go undetected. Whenever internal failures occur, the system immediately goes to an abort mode, ensuring that all actuators in the system have been turned off, and a return to, or initiation of, normal operation is prevented until the failure has been corrected. When a fault condition is detected, the system immediately reverts to an appropriate lower operating state and remains at such state until the fault condition is corrected.

For these reasons, the preferred embodiment of the present invention includes an auxiliary brake 58 that is automatically engaged in the abort mode. Furthermore, the auxiliary brake 58 will also be engaged, and belt tension released, whenever electrical power to the control is interrupted or there is a loss of hydraulic pressure. This arrangement is particularly advantageous whenever the road planer 10 is shut down for service or during periods of nonoperation, such as overnight, thereby extending the service life of the endless belt 38.

Thus, the present invention provides a control system for a rotary cutter in which the mechanical drive components are selectively and sequentially controlled in response to operator inputs and to sensed operating conditions. The control responds to the occurrence of predefined fault events and internal system failures by controlling the operation of one or more of the mechanical drive line components in a preselected order. Furthermore, suitable time delays are provided between the execution of selected commands to prevent undesirable wear or loads on components of the drive train.

The rotary cutter control logic described in the flowcharts shown in FIGS. 6 through 14 may conveniently be included as one module of a comprehensive control program that includes, in the aforementioned computational loop, control modules for vehicle steering, propulsion and other functions such as warnings and displays. The same microprocessor 94 can easily be programmed to process additional inputs, integrate the execution of the cutter, steering, propulsion, warning and display software programs, and develop control signals to support additional control functions.

Other aspects, objects and advantages of this invention can be obtained from a study of the drawings, the disclosure, and the appended claims.

We claim:

1. A control system for a road planer having a cutter rotatably mounted on said road planer, an engine operatively connected to the rotatable cutter, and at least one panel covering an access opening in said road planer, said control system comprising:

a clutch operatively connected to said engine and having an output shaft extending therefrom;

clutch control means for selectively engaging and disengaging said clutch;

a brake operatively connected to the output shaft;

brake control means for selectively applying and releasing said brake;

a first pulley operatively connected to said output shaft;

a second pulley connected to said rotatably mounted cutter;

an endless belt extending between said pulleys;

means for tensioning said belt and urging said belt into driving contact with said first and second pulleys;

belt tensioning control means for selectively engaging and releasing said belt tensioning means;

means for selecting one of a plurality of predetermined cutter operating modes and developing and delivering a first output signal corresponding to said selected operating mode; and, means for controlling preselected ones of said belt tensioning control means, brake control means and clutch control means in a preselected sequential order in response to receiving said first output signal.

2. A control system, as set forth in claim 1, wherein said control system includes means for sensing at least one operating condition and developing and delivering a second output signal corresponding to said operating condition.

3. A control system, as set forth in claim 2, wherein said sequentially controlling means includes a microprocessor having inputs for receiving said first and second output signals and developing and delivering first, second, and third control signals respectively to said clutch control means, said brake control means, and said belt tensioning control means.

4. A control system, as set forth in claim 2, wherein said road planer includes a hydraulically controlled frame suspension system, and said sensing means includes a hydraulic fluid pressure switch in said hydraulically controlled frame suspension system.

5. A control system, as set forth in claim 1, wherein said control system includes means for sensing the position of said at least one panel and developing and delivering a third output signal indicative of said panel position.

6. A control system, as set forth in claim 5, wherein said sequentially controlling means includes a microprocessor having inputs for receiving said first and third output signals and developing and delivering first, second, and third control signals respectively to said clutch control means, said brake control means, and said belt tensioning control means.

7. A control system, as set forth in claim 1, wherein said control system includes means for sensing a least one operating condition and developing and delivering a second output signal corresponding to said condition, and means for sensing the position of said at least one panel and developing and delivering a third output signal indicative of said panel position

8. A control system, as set forth in claim 7, wherein said sequentially controlling means includes a microprocessor having inputs for receiving said first, second and third output signals and developing and delivering first, second and third control signals respectively to said clutch control means, said brake control means, and said belt tensioning control means.

9. A control system, as set forth in claim 1, including an auxiliary brake interposed said brake and said first pulley and operatively connected to said output shaft.

10. A control system, as set forth in claim 9, wherein said belt tensioning control means applies said auxiliary brake concurrently with releasing said belt tensioning means and releases said auxiliary brake concurrently with engaging said belt tensioning means.

11. A control system, as set forth in claim 1, wherein said clutch is hydraulically actuated and said clutch control means is electrically operated.

12. A control system, as set forth in claim 1, wherein said brake is hydraulically actuated and said brake control means is electrically operated.

13. A control system, as set forth in claim 1, wherein said belt tensioning means includes an hydraulically actuated cylinder and said means for controlling said belt tensioning means is electrically operated.

14. A control system, as set forth in claim 9, wherein said auxiliary brake is mechanically engaged and hydraulically released, and said controlling means of said belt tensioning means is electrically operated.

* * * * *